US009035933B2

(12) United States Patent
Lin et al.

(10) Patent No.: US 9,035,933 B2
(45) Date of Patent: May 19, 2015

(54) DISPLAY APPARATUS AND METHOD FOR GENERATING GATE SIGNAL THEREOF

(71) Applicant: Au Optronics Corporation, Hsinchu (TW)

(72) Inventors: Ya-Ting Lin, Taichung (TW); Yu-Chung Yang, Taichung (TW); Chun-Hsin Liu, Yunlin County (TW); Kun-Yueh Lin, Chiayi County (TW)

(73) Assignee: Au Optronics Corporation, Hsinchu (TW)

( * ) Notice: Subject to any disclaimer, the term of this patent is extended or adjusted under 35 U.S.C. 154(b) by 239 days.

(21) Appl. No.: 13/727,606

(22) Filed: Dec. 27, 2012

(65) Prior Publication Data

US 2014/0078127 A1 Mar. 20, 2014

(30) Foreign Application Priority Data

Sep. 14, 2012 (TW) ..... 101133835 A

(51) Int. Cl.
*G09G 3/36* (2006.01)

(52) U.S. Cl.
CPC ..... *G09G 3/3611* (2013.01); *G09G 3/3659* (2013.01); *G09G 3/3677* (2013.01); *G09G 2300/0814* (2013.01); *G09G 2300/0852* (2013.01); *G09G 2300/0876* (2013.01)

(58) Field of Classification Search
None
See application file for complete search history.

(56) References Cited

U.S. PATENT DOCUMENTS

| | | | | |
|---|---|---|---|---|
| 7,746,314 | B2 * | 6/2010 | Wei et al. | 345/100 |
| 2005/0078076 | A1 * | 4/2005 | Kim et al. | 345/98 |
| 2005/0156860 | A1 * | 7/2005 | Kim et al. | 345/100 |
| 2006/0227095 | A1 * | 10/2006 | Kim et al. | 345/100 |
| 2008/0246038 | A1 * | 10/2008 | Um et al. | 257/72 |
| 2008/0266275 | A1 * | 10/2008 | Tsai et al. | 345/204 |
| 2008/0284704 | A1 * | 11/2008 | Song et al. | 345/94 |

(Continued)

FOREIGN PATENT DOCUMENTS

| | | |
|---|---|---|
| CN | 101236736 A | 8/2008 |
| CN | 101604514 | 12/2009 |

(Continued)

OTHER PUBLICATIONS

"Office Action of Taiwan Counterpart Application", issued on Jun. 11, 2014, p. 1-p. 6, in which the listed references were cited.

(Continued)

*Primary Examiner* — Kathy Wang-Hurst
*Assistant Examiner* — Josemarie G Acha, III
(74) *Attorney, Agent, or Firm* — Jianq Chyun IP Office

(57) ABSTRACT

A display apparatus and a method for generating gate signal thereof are provided. The display apparatus includes a timing controller and a display panel. The timing controller is used for providing a plurality of timing signals. The display panel includes a pixel array and a gate drive circuit. The pixel array has a plurality of pixels. The gate drive circuit is electrically connected to the timing controller and the pixel array and including a plurality of shift register circuits. The shift register circuit includes a first shift register and a second shift register. The first shift register is configured for generating a corresponding primary gate signal. The second shift register is configured for generating a corresponding secondary gate signal. The timing controller adjusts overlapping relations of the timing signals according to a frame rate of the display apparatus.

16 Claims, 11 Drawing Sheets

(56) References Cited

U.S. PATENT DOCUMENTS

| | | | | |
|---|---|---|---|---|
| 2009/0189677 | A1* | 7/2009 | Lee et al. | 327/427 |
| 2009/0243974 | A1* | 10/2009 | Tanaka et al. | 345/58 |
| 2010/0060619 | A1* | 3/2010 | Kim et al. | 345/205 |
| 2010/0238143 | A1* | 9/2010 | Liu et al. | 345/204 |
| 2010/0260312 | A1* | 10/2010 | Tsai et al. | 377/79 |
| 2011/0115998 | A1* | 5/2011 | Liao et al. | 349/38 |
| 2011/0156997 | A1* | 6/2011 | Han et al. | 345/100 |
| 2011/0157124 | A1* | 6/2011 | Jung et al. | 345/211 |
| 2011/0234577 | A1* | 9/2011 | Yang et al. | 345/212 |
| 2011/0273417 | A1* | 11/2011 | Shin et al. | 345/211 |
| 2011/0280362 | A1* | 11/2011 | Jang | 377/64 |
| 2011/0316831 | A1* | 12/2011 | Ochiai et al. | 345/208 |
| 2011/0316833 | A1* | 12/2011 | Chang et al. | 345/211 |
| 2012/0013585 | A1* | 1/2012 | Jang | 345/208 |
| 2012/0162170 | A1* | 6/2012 | Ochiai et al. | 345/208 |
| 2012/0188211 | A1* | 7/2012 | Tsai et al. | 345/205 |
| 2012/0223927 | A1* | 9/2012 | Hsieh et al. | 345/211 |

FOREIGN PATENT DOCUMENTS

| | | | |
|---|---|---|---|
| CN | 102054422 | A | 5/2011 |
| TW | 200611234 | | 4/2006 |
| TW | 201040931 | | 11/2010 |
| TW | 201134097 | | 10/2011 |
| TW | 201218170 | | 5/2012 |

OTHER PUBLICATIONS

"Office Action of China Counterpart Application", issued on Aug. 28, 2014, p. 1-p. 6, in which the listed reference was cited.

"First Office Action of China Counterpart Application", issued on Mar. 5, 2014, p. 1-p. 6, in which the listed references were cited.

* cited by examiner

DISPLAY APPARATUS AND METHOD FOR GENERATING GATE SIGNAL THEREOF

CROSS-REFERENCE TO RELATED APPLICATION

This application claims the priority benefit of Taiwan application serial no. 101133835, filed on Sep. 14, 2012. The entirety of the above-mentioned patent application is hereby incorporated by reference herein and made a part of this specification.

BACKGROUND

1. Field of the Disclosure

The disclosure relates to a display apparatus and a method for generating gate signal thereof. More particularly, the disclosure relates to a display apparatus employing various driving method and a method for generating gate signal using the same.

2. Description of Related Art

With rapidly advancing semiconductor technologies in the recent years, portable electronics and flat panel displays have also gained popularity. In various types of flat displays, liquid crystal displays (LCDs) have gradually become the main stream of display products due to features such as low voltage operation, radiation-free scattering, light weight, compactness, and the like. As a consequence, a fabricating method is developed towards miniature and low cost by manufacturers in this field.

In order to reduce the manufacturing cost of LCDs, a method of manufacturing gate on array directly on the display panel is proposed to obtain a slim border, thereby achieving the purpose of reducing manufacturing cost of LCDs. However, since the shift register is composed of thin-film transistors being formed on the substrate, the driving capability of the shift register may be limited by the manufacturing process of the thin-film transistor. In order to increase viewing effect from different angles, a method of designing pixels to solve a washout problem is also proposed. Therefore, more scan signals are required as to allow a single pixel to perform charging and charge sharing. In addition, gate drive circuit is generally designed for adapting single driving method, so that commonality of shift register cannot be applied to different frame rates.

SUMMARY OF THE DISCLOSURE

A display apparatus and a method for generating gate signal using the same are provided, by adjusting overlapping relations and enable periods of timing signals to adjust driving method of the display apparatus according to different frequency, so that overlapping relations and enable periods of the primary gate signals and overlapping relations and enable periods of the secondary gate signals may both be adjusted.

The disclosure provides a display apparatus, including a timing controller, a pixel array and a gate drive circuit. The timing controller is used for providing a plurality of timing signals; the pixel array has a plurality of pixel units; the gate drive circuit is electrically connected to the timing controller and the pixel array and including a plurality of shift register circuits. An Nth stage shift register circuit includes a first shift register and a second shift register. A first shift register is used for generating an Nth stage primary gate signal. A second shift register is used for generating an Nth stage secondary gate signal. The timing controller adjusts overlapping relations of the timing signals according to a frame rate of the display apparatus, and N is a natural number.

According to an embodiment of the disclosure, the first shift register and the second shift register respectively include a pull-up unit, a drive unit, an auxiliary drive unit, a first control unit, a second control unit, a first auxiliary pull-down unit, a second auxiliary pull-down unit and a pull-down unit. The pull-up unit raises a drive voltage according to an (N−1) th stage reference signal, an (N−2)th stage reference signal, an (N−4)th stage reference signal, an (N−5)th stage reference signal and an (N+4)th stage reference signal. The drive unit receives a first timing signal and outputs the Nth stage primary gate signal or the Nth stage secondary gate signal according to the drive voltage and the first timing signal. The auxiliary drive unit receives the first timing signal and outputs an Nth stage reference signal according to the drive voltage and the first timing signal. The first control unit receives a first low-frequency signal and generates a first control signal according to the first low-frequency signal. The second control unit receives a second low-frequency signal and generates a second control signal according to the second low-frequency signal. The first auxiliary pull-down unit is electrically connected to a first low voltage, a second low voltage and the first control signal, and pull down the Nth stage reference signal and the Nth stage primary gate signal or the Nth stage secondary gate signal according to the first control signal. The second auxiliary pull-down unit is electrically connected to the first low voltage, the second low voltage and the second control signal, and pull down the Nth stage reference signal and the Nth stage primary gate signal or the Nth stage secondary gate signal according to the second control signal. The pull-down unit receives the second low voltage and the (N+4)th stage reference signal, and pull down the drive voltage and the Nth stage primary gate signal or the Nth stage secondary gate signal according to the second control signal according to the (N+4)th stage reference signal.

The disclosure provides a method for generating a gate signal of a display apparatus, in which the display apparatus includes a pixel array, a timing controller and a gate drive circuit, the method for generating gate signal including the following steps. Providing a start signal and a plurality of timing signals by the timing controller. Adjusting enable period of the start signal according to a frame rate of the display apparatus, and adjusting enable periods and overlapping relations of the timing signals by the timing controller. Providing a plurality of primary gate signals and a plurality of secondary gate signals to the pixel array according to the plurality of timing signals by the gate drive circuit.

In view of above, the embodiments of the disclosure provide a display apparatus and a method for generating gate signal using the same, in which the timing controller adjusts enable periods and overlapping relation of a start signal and the timing signals according to a frame rate of the display apparatus. As a result, enable periods and overlapping relations of the primary gate signal may be adjusted, and enable periods and overlapping relations of the virtual secondary gate signal and the secondary gate signal may also be adjusted, thereby increasing a commonality of the gate drive circuit.

To make the above features and advantages of the disclosure more comprehensible, several embodiments accompanied with drawings are described in detail as follows.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF THE EMBODIMENTS

Figure 1:
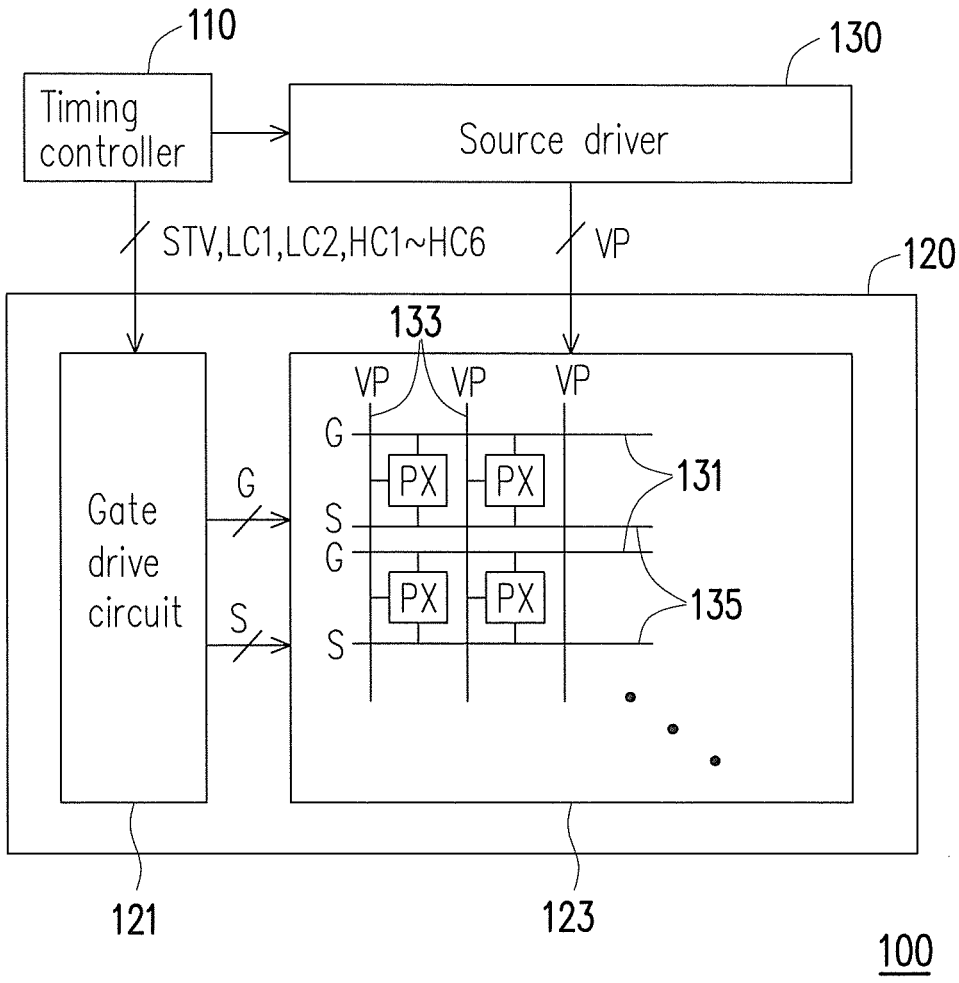
FIG. 1 is a schematic view illustrating a system of a display apparatus according to an embodiment of the disclosure.

FIG. 1 is a schematic view illustrating a system of a display apparatus according to an embodiment of the disclosure. Referring to FIG. 1, according to the present embodiment, the display apparatus 100 includes a timing controller 110, a display panel 120 and a source drive circuit 130. The source drive circuit 130 is electrically connected to the timing controller 110 and controlled by the timing controller to provide a plurality of pixel voltages VP.

The display panel 120 includes a gate drive circuit 121 and a pixel array 123. The gate drive circuit 121 is electrically connected to the timing controller 110, so as to receive a start signal STV, a first low-frequency signal LC1, a second low-frequency signal LC2 and a plurality of timing signals HC1 to HC6 provided by the timing controller 110, thereby providing a plurality of primary gate signals G and a plurality of secondary gate signal S according to the start signal STV, the first low-frequency signal LC1, the second low-frequency signal LC2 and the plurality of timing signals HC1 to HC6. In which, the first low-frequency signal LC1 and the second low-frequency signal LC2 may respectively be an inversion signal to one another.

The pixel array 123 includes a plurality of first gate lines 131, a plurality of data lines 133, a plurality of second gate lines 135 and a plurality of pixels PX arranged in an array. Each of the first gate lines 131 is used for receiving a corresponding primary gate signal G, each of the data lines 133 is used for receiving a corresponding pixel voltage VP and each of the second gate lines 135 is used for receiving a corresponding secondary gate signal S. Further, each of the pixels PX is electrically connected to a corresponding first gate line 131 to receive a corresponding primary gate signal G; each of the pixels PX is electrically connected to a corresponding data line 133 to receive a corresponding pixel voltage VP; and each of the pixels PX is electrically connected to a corresponding second gate line 135 to receive a corresponding secondary gate signal S.

Figure 2:
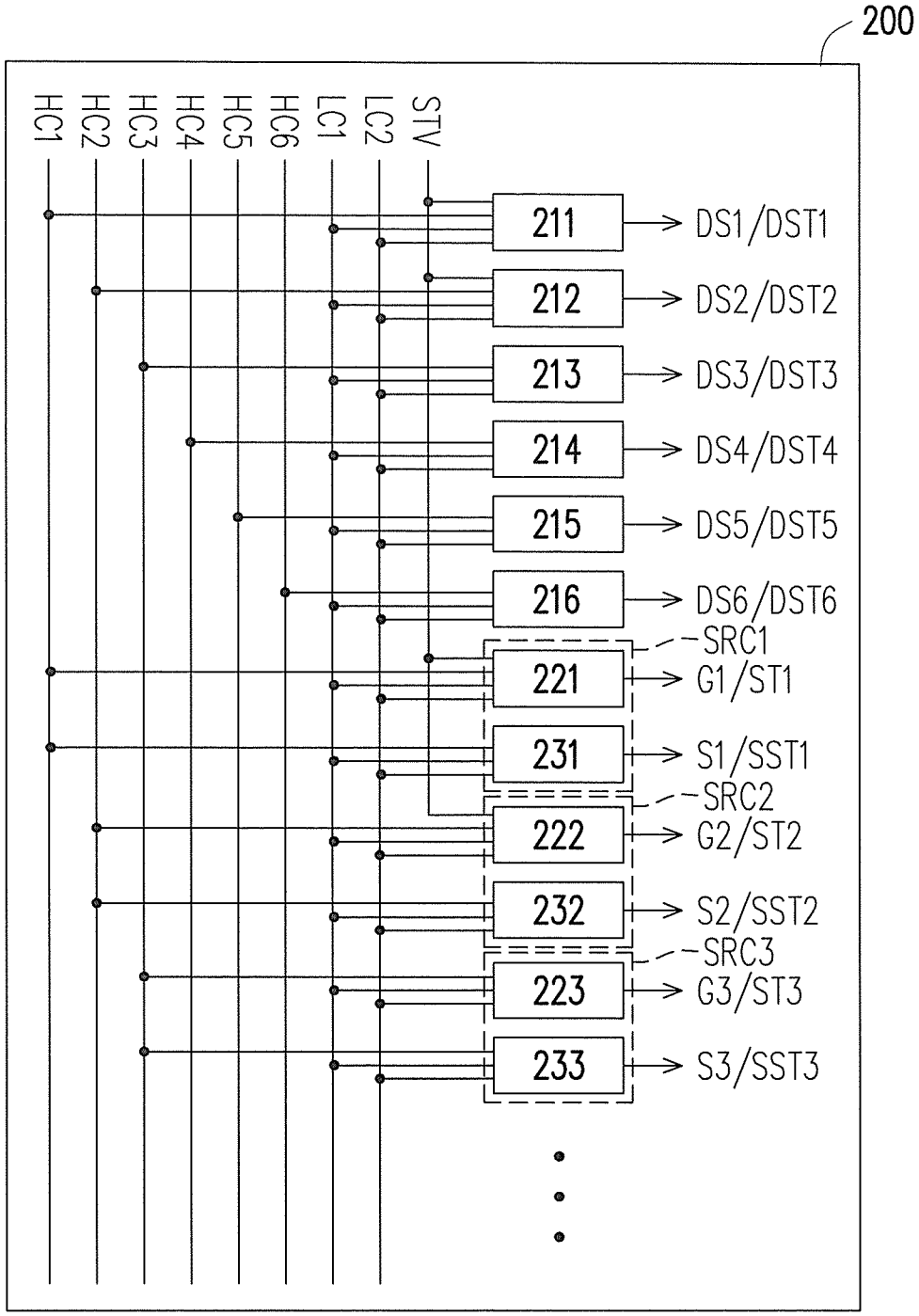
FIG. 2 is a schematic view illustrating a system of a gate drive circuit according to an embodiment of the disclosure.

FIG. 2 is a schematic view illustrating a system of a gate drive circuit according to an embodiment of the disclosure. Referring to FIG. 1 and FIG. 2, according to the present embodiment, the gate drive circuit 121 may be implemented by a gate drive circuit 200. The gate drive circuit 200 includes multiple stages of shift register circuit (e.g., SRC1 to SRC3), each stage of the shift register circuits includes a first shift register (e.g., 221 to 223) and a second shift register (e.g., 231 to 233). Each of the first shift registers (e.g., 221 to 233) receives one of the timing signals HC1 to HC6, the first low-frequency signal LC1 and the second low-frequency signal LC2, for generating a corresponding primary gate signal (e.g., G1 to G3) and a corresponding primary reference signal (e.g., ST1 to ST3) according to the timing signal (e.g., HC1 to HC6), the first low-frequency signal LC1 and the second low-frequency signal LC2 received. In which, the first shift register 221 of the first stage shift register circuit SRC1 and the first shift register 222 of the second shift register circuit SRC2 further receive the start signal STV to further generate the primary gate signals G1 and G2 and the primary gate signals ST1 and ST2 according to the start signal STV.

Each of the second shift registers (e.g., 231 to 233) receives one of the timing signals HC1 to HC6, the first low-frequency signal LC1 and the second low-frequency signal LC2, for generating a corresponding secondary gate signal (e.g., S1 to S3) and a corresponding secondary reference signal (e.g., SST1 to SST3) according to the timing signal (e.g., HC1 to HC6), the first low-frequency signal LC1 and the second low-frequency signal LC2 received.

In addition, a plurality of virtual second shift registers 211 to 216 are included prior to or posterior to the plurality of the shift register circuits (e.g., SRC1 to SRC3). The virtual second shift registers 211 to 216 respectively receives the timing signals HC1 to HC6, the first low-frequency signal LC1 and the second low-frequency signal LC2, for generating a plurality of virtual secondary gate signals DS1 to DS6 and a plurality of virtual secondary reference signals DST1 to DST6 according to the timing signals HC1 to HC6, the first low-frequency signal LC1 and the second low-frequency signal LC2. In which, the virtual second shift registers 211 and 212 receive the start signal STV to further generate the virtual secondary gate signals DS1 and DS2 and the virtual reference signals DST1 and DST2 according to the start signal STV.

According to the present embodiment, the first shift registers (e.g., 221 to 223) of the shift register circuits (e.g., SRC1 to SRC3) are triggered sequentially, so as to sequentially provide enabled primary gate signals (e.g., G1 to G3) and sequentially provide enabled primary reference signals (e.g., ST1 to ST3); the virtual second shift registers 211 to 216 and the second shift registers (e.g., 231 to 233) of the shift register circuits (e.g., SRC1 to SRC3) are triggered sequentially, so as to sequentially provide enabled virtual secondary gate signals DS1 to DS6 and enabled secondary gate signals (e.g., S1 to S3), and sequentially provide enabled virtual reference signals DST1 to DST6 and enabled secondary reference signals (e.g., SST1 to SST3).

Figure 3A:
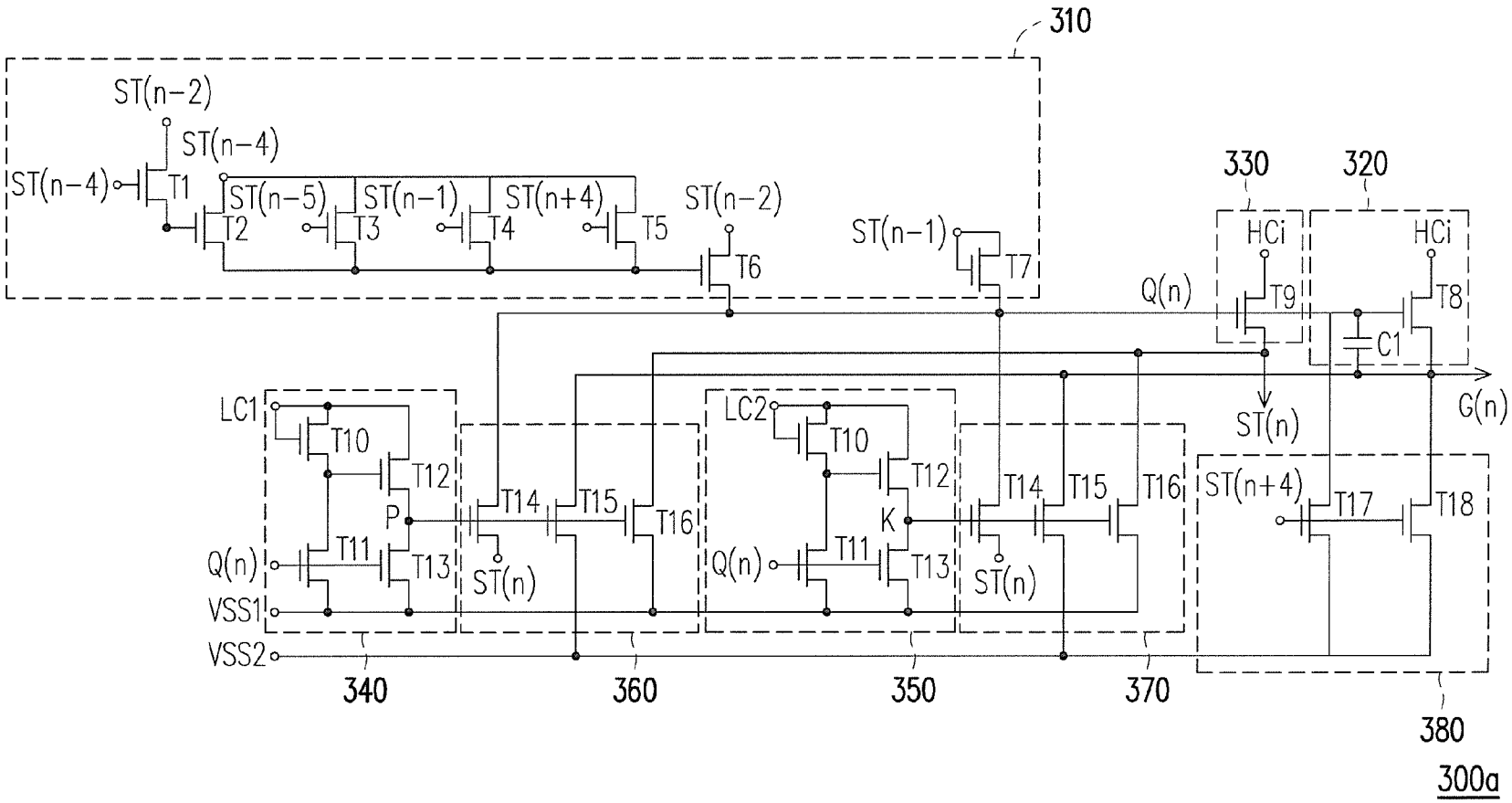
FIG. 3A is a schematic view illustrating circuits in a first shift register according to an embodiment of the disclosure.

FIG. 3A is a schematic view illustrating circuits in a first shift register according to an embodiment of the disclosure. Referring to FIG. 3A, a first shift register 300*a* includes a pull-up unit 310, a drive unit 320, an auxiliary drive unit 330, a first control unit 340, a second control unit 350, a first auxiliary pull-down unit 360, a second auxiliary pull-down unit 370 and a pull-down unit 380.

The pull-up unit 310 pulls up a drive voltage Q(n) according to the primary reference signals ST(n−1), ST(n−2), ST(n−4), ST(n−5) and ST(n+4), in which the primary reference signal ST(n−1) indicates that it is provided by the first shift registers (e.g., 221 to 223) of the previous stage, the primary reference signal ST(n+1) indicates that it is provided by the first shift registers (e.g., 221 to 223) of the next stage, the rest of the shift registers are indicated using the same method as above with n being a natural number. The drive unit 320 receives a timing signal HCi, in which i=1 to 6. That is, the drive unit 320 receives one of the timing signals HC1 to HC6. The drive unit 320 outputs a corresponding primary gate signal G(n) according to the drive voltage Q(n) and the timing signals (e.g., HC1 to HC6) received. The auxiliary drive unit 330 receives one of the timing signals HC1 to HC6 and outputs a corresponding primary reference signal ST(n) according to the drive voltage Q(n) and the timing signals (e.g., HC1 to HC6) received.

The first control unit 340 receives the first low-frequency signal LC1 and generating a first control signal P according to the first low-frequency signal LC1. The second control unit 350 receives the second low-frequency signal LC2 and generating a second control signal K according to the second low-frequency signal LC2. The first auxiliary pull-down unit 360 is electrically connected to a first low voltage VSS1, a second low voltage VSS2 and the first control signal P, for pulling down the primary reference signal ST(n) and the primary gate signal G(n) according to the first control signal P.

The second auxiliary pull-down unit 370 is electrically connected to the first low voltage VSS1, the second low voltage VSS2 and the second control signal K, for pulling down the primary reference signal ST(n) and the primary gate signal G(n) according to the second control signal K; The pull-down unit 380 receives the second low voltage VSS2 and the primary reference signal ST(N+4), for the pulling down the drive voltage Q(n) and the primary gate signal G(n) according to the primary reference signal ST(n+4).

More particularly, the pull-up unit 310 includes transistors T1 to T7. The transistor T1 has a first terminal for receiving the primary reference signal ST(n−2), a control terminal for receiving the primary reference signal ST(n−4) and a second terminal. The transistor T2 has a first terminal for receiving the primary reference signal ST(n−4), a second terminal and a control terminal electrically connected to the second terminal of the transistor T1. The transistor T3 has a first terminal for receiving the primary reference signal ST(n−4), a control terminal for receiving the primary reference signal ST(n−5) and a second terminal electrically connected to the second terminal of the transistor T2.

The transistor T4 has a first terminal for receiving the primary reference signal ST(n−4), a control terminal for receiving the primary reference signal ST(n−1) and a second terminal electrically connected to the second terminal of the transistor T2. The transistor T5 has a first terminal for receiving the primary reference signal ST(n−4), a control terminal for receiving the primary reference signal ST(n+4) and a second terminal electrically connected to the second terminal of the transistor T2. The transistor T6 has a first terminal for receiving the primary reference signal ST(n−2), a control terminal electrically connected to the second terminal of the transistor T2 and a second terminal for outputting the drive voltage Q(n). The transistor T7 has a first terminal and a control terminal for receiving the primary reference signal ST(n−1) and has a second terminal electrically connected to the second terminal of the transistor T6.

The drive unit 320 includes a transistor T8 having a first terminal for receiving the timing signal HCi, a control terminal for receiving the drive voltage Q(n) and a second terminal for outputting the primary gate signal G(n). In addition, the drive unit 320 may further include a capacitor C1 electrically connected between the control terminal of the transistor T8 and the second terminal of the transistor T8. The auxiliary drive unit 330 includes a transistor T9 having a first terminal for receiving the timing signal HCi, a control terminal for receiving the drive voltage Q(n) and a second terminal for outputting the primary reference signal ST(n).

The first control unit 340 and the second control unit 350 respectively include transistors T10 to T13. The transistor T10 has a first terminal and a control terminal for receiving the first low-frequency signal LC1 or the second low-frequency signal LC2, and a second terminal, in which the first terminal of the transistor T10 of the first control unit 340 receives the first low-frequency signal LC1 and the first terminal of the transistor T10 of the second control unit 350 receives the second low-frequency signal LC2.

The transistor T12 has a first terminal electrically connected to the first terminal of the transistor T10, a control terminal electrically connected to the second terminal of the transistor T10 and a second terminal for outputting the first control signal P or the second control signal K, in which the second terminal of the transistor T12 of the first control unit 340 outputs the first control signal P and the second terminal of the transistor T12 of the second control unit 350 outputs the second control signal K.

The transistor T11 has a first terminal electrically connected to the second terminal of transistor T10, a control terminal for receiving the drive voltage Q(n) and a second terminal electrically connected to the first low voltage VSS1. The transistor T13 has a first terminal electrically connected to the second terminal of transistor T12, a control terminal electrically connected to the control terminal of the transistor T11 and a second terminal electrically connected to the first low voltage VSS1.

The first auxiliary pull-down unit 360 and the second auxiliary pull-down unit 370 respectively include transistors T14 to T16. The transistor T14 has a first terminal electrically connected to drive voltage Q(n), a control terminal for receiving the first control signal P or the second control signal K and a second terminal for receiving the primary reference signal ST(n), in which the control terminal of the transistor T14 of the first auxiliary pull-down unit 360 receives the first control signal P, and the control terminal of the transistor T14 of the second auxiliary pull-down unit 370 receives the second control signal K.

The transistor T15 has a first terminal electrically connected to the primary gate signal G(n), a control terminal electrically connected to the control terminal of the transistor T14 and a second terminal electrically connected to the second low voltage VSS2. The transistor T16 has a first terminal for receiving the primary reference signal ST(n), a control terminal electrically connected to the control terminal of the transistor T14 and a second terminal electrically connected to the first low voltage VSS1.

The pull-down unit 380 includes transistors T17 and T18. The transistor T17 has a first terminal electrically connected to the drive voltage Q(n), a control terminal for receiving the primary reference signal ST(n+4) and a second terminal electrically connected to the second low voltage VSS2. The transistor T18 has a first terminal electrically connected to the primary gate signal G(n), a control terminal electrically connected to the control terminal of the transistor T17 and a second terminal electrically connected to the second low voltage VSS2.

According to the present embodiment, voltage levels of the first low voltage VSS1 and the second low voltage VSS2 are lower than the ground potential, and the configuration may be set to have the first low voltage VSS1 not being larger than the second low voltage VSS2. For example, the second low voltage VSS2 may be equal to the first low voltage VSS1 or the second low voltage VSS2 may be larger than the first low voltage VSS1, so as to reduce the leakage current when the transistors T15, T17 and T18 are turned off.

Figure 3B:
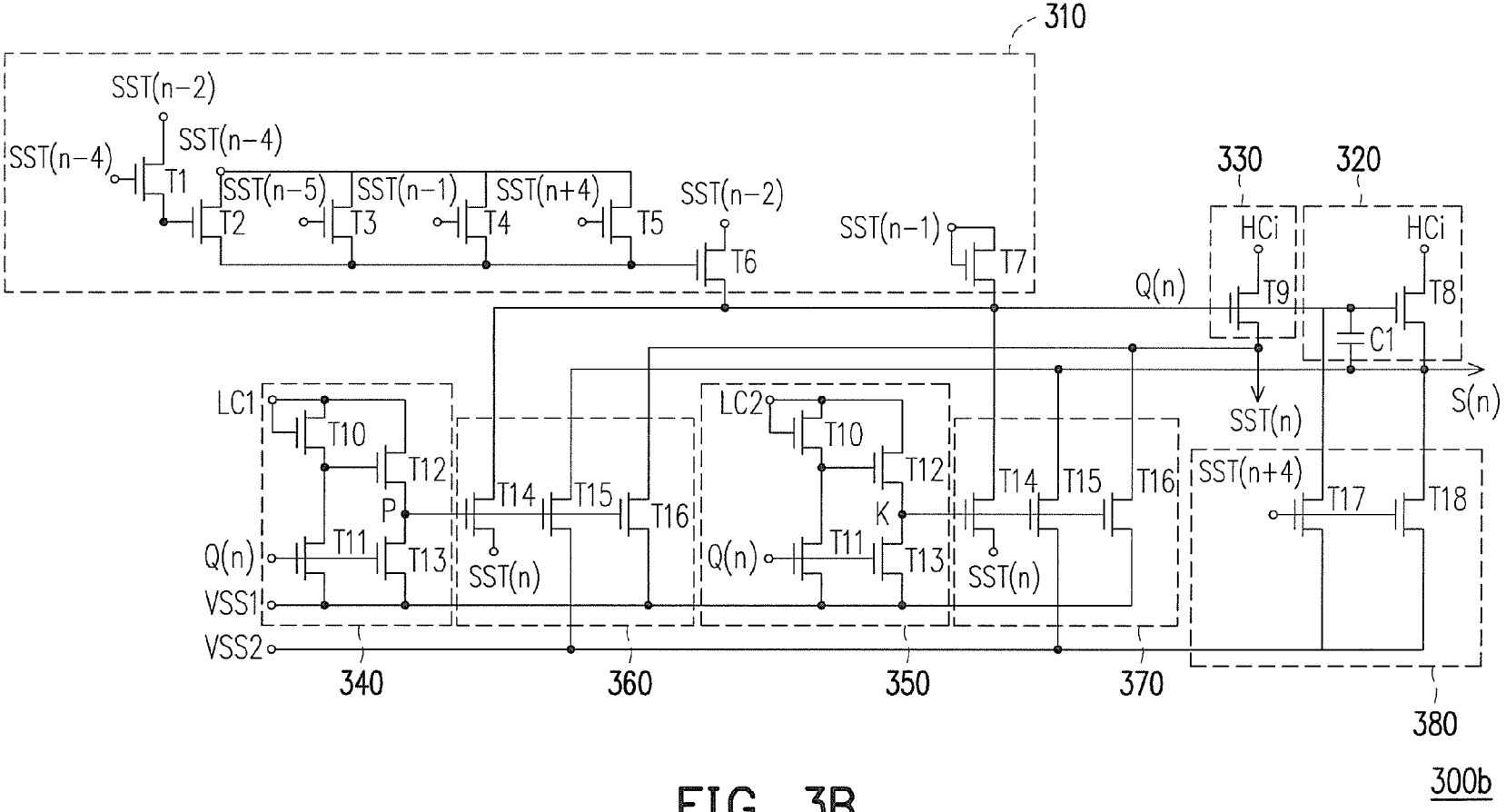
FIG. 3B is a schematic view illustrating circuits in a second shift register according to an embodiment of the disclosure.

FIG. 3B is a schematic view illustrating circuits in a second shift register according to an embodiment of the disclosure. According to the present embodiment, a second shift register 300*b* is a circuitry structure of the virtual second shift registers 211 to 216 and the second shift registers (e.g., 231 to 233), which is similar to the first shift register 300*a*. However, the primary reference signal ST(n−5), the primary reference signal ST(n−4), the primary reference signal ST(n−2), the primary reference signal ST(n−1), the primary reference signal ST(n), the primary reference signal ST(n+4) and the primary gate signal G(n) as labeled in the first shift register 300*a* are respectively replaced by the secondary reference signal SST (n−5), the secondary reference signal SST(n−4), the secondary reference signal SST(n−2), the secondary reference signal SST(n−1), the secondary reference signal SST(n), the secondary reference signal SST(n+4) and the secondary gate signal S(n).

Figure 4A:
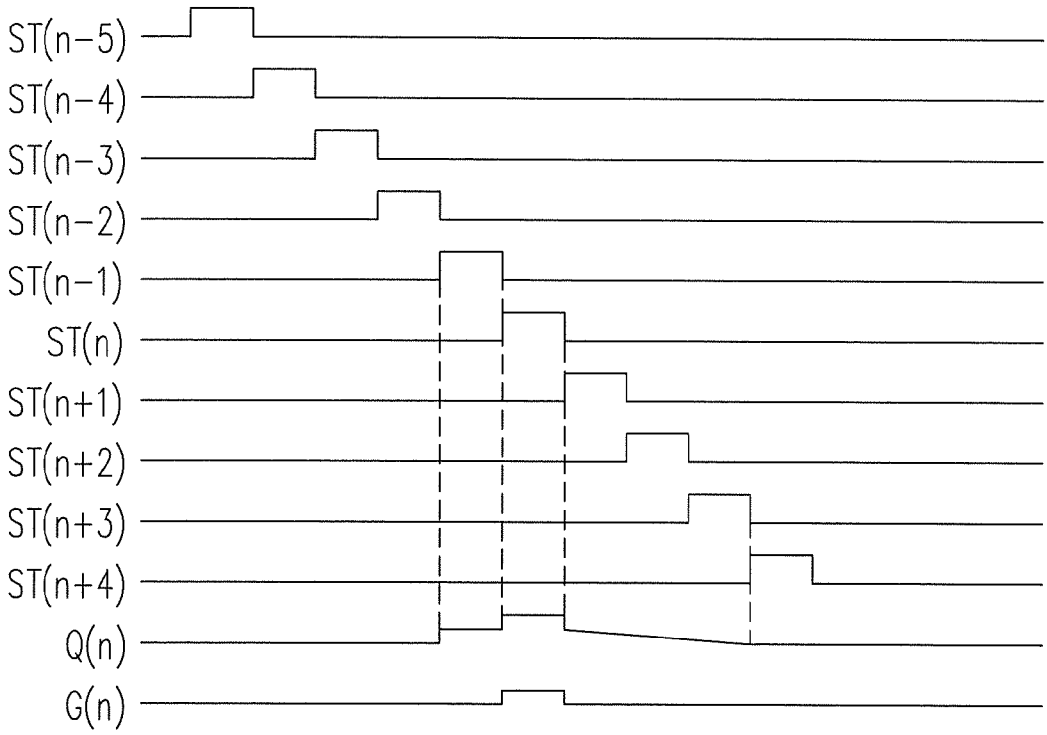
FIG. 4A and FIG. 4B are schematic views illustrating driving waveforms of a display apparatus in a frame rate of 60 Hz according to an embodiment of the disclosure.
Figure 4B:
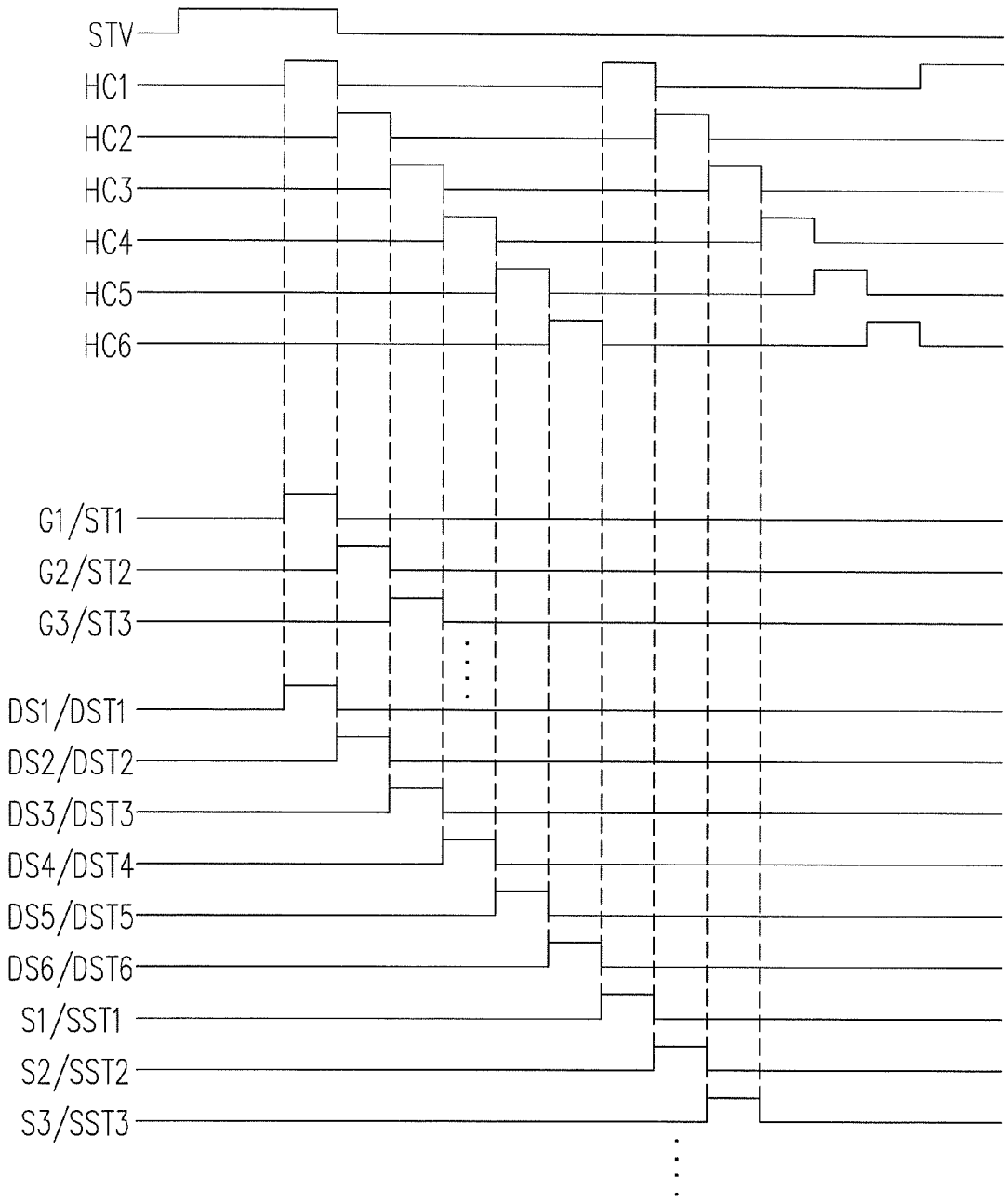

FIG. 4A and FIG. 4B are schematic views illustrating driving waveforms of a display apparatus in a frame rate of 60 Hz according to an embodiment of the disclosure. Referring to FIG. 3A, FIG. 3B, FIG. 4A and FIG. 4B, take the primary gate signal as an example, in the present embodiment, when charging the pixel, the first shift registers (e.g., 221 to 223) output the corresponding primary reference signals (e.g., ST(n−5) to ST(n+4)) and the corresponding primary gate signals (e.g., G1 to G3) according to corresponding timing signals HC1 to HC6. In addition, when the time frame is 60 Hz (corresponding to as a first frequency), it is set that enable periods of the timing signals HC1 to HC6 are not overlapped with each other, such that enable periods of the plurality of the primary reference signals (e.g., ST(N−5) to ST(N+4)) outputted from the first shift registers (e.g., 221 to 223) in the present embodiment are not overlapped with each other, and the enable periods of the primary gate signals (e.g., G1 to G3) outputted from the same are not overlapped with each other.

Referring to FIG. 3A and FIG. 4A, the transistor T3 is turned on when the primary reference signal ST(n−5) is enabled; the transistor T1 is turned on when the primary reference signal ST(n−4) is enabled. However, since the enabled periods of the primary reference signals ST(n−5) to ST(n−2) are not overlapped with each other, the drive voltage Q(n) is not pulled up by the transistors T1 to T6 before the primary reference signals ST(n−1) is enabled. The transistor T7 is turned on when the primary reference signal ST(n−1) is enabled, in which the enabled primary reference signal ST(n−1) performs charging to a capacitor C1, so as to pull up the drive voltage Q(n), and the transistors T8 and T9 are turned on when the drive voltage Q(n) is larger than threshold voltage of the transistors T8 and T9.

Next, when the timing signals HCi received by the first terminals of the transistors T8 and T9 are enabled, the enabled primary gate signal G(n) is outputted from the second terminal of the transistor T8 and the enabled primary reference signal ST(n) is outputted from the second terminal of the transistor T9. In this case, due to voltage drop of the capacitor C1, the drive voltage Q(n) is pulled up higher, such that the first control signal P and the second control signal K cannot be enabled by the first control unit 340 and the second control unit 350. Therefore, voltage levels of the enabled primary gate signal G(n), the enabled primary reference signal ST(n) and the drive voltage Q(n) may not be pulled down by the first auxiliary pull-down unit 360 and the second auxiliary pull-down unit 370.

When the timing signals HCi received by the first terminals of the transistors T8 and T9 are disabled, the first control signal P and the second control signal K are respectively enabled by the first control unit 340 and the second control unit 350 according to the first low-frequency signal LC1 and the second low-frequency signal LC2, respectively. It is assumed that the first low-frequency signal LC1 and the second low-frequency signal LC2 are respectively being an inversion signal to one another, so one of the first control signal P and the second control signal K may be enabled, and voltage levels of the primary gate signal G(n), the primary reference signal ST(n) and the drive voltage Q(n) are pulled down by the first auxiliary pull-down unit 360 or the second auxiliary pull-down unit 370. The pull-down unit 380 is conducted to pull down voltage levels of the drive voltage Q(n) and the primary gate signal G(n) when the primary reference signal ST(n+4) is enabled; in addition, the transistor T5 is conducted to pull down voltage level of the control terminal of the transistor T6.

According to the present embodiment, operations of the second shift register (e.g., 231 to 233) are similar to operations of the first shift register (e.g., 221 to 223). That is, the enable periods of the secondary reference signals SST(n−5) to SST(n+4) are not overlapped with each other, such that the enable periods of the virtual secondary gate signals DS1 to DS6 and the secondary gate signal (e.g., S1 to S3) are not overlapped with each other.

As illustrated in FIG. 4B, the enable period of each of the primary gate signals (e.g., G1 to G3) is not overlapped with the enable period of a corresponding secondary gate signal (e.g., S1 to S3), and the enable period of each of the primary gate signals (e.g., G1 to G1) is prior to the enable period of a corresponding secondary gate signal (e.g., S1 to S3). The enable period in each of the primary gate signals (e.g., G1 to G3) is substantially prior to that of a corresponding secondary gate signals (e.g., S1 to S3) by 6 stages. For example, the enable period of the primary gate signal G1 is substantially overlapped with the enable period of the virtual secondary gate signal DS1, and the virtual reference signal DST1 is substantially the same to the secondary reference signal SST (1-6). Based on above, in some embodiment, the primary reference signal ST(n+4) received by the control terminal of the transistor T17 may be replaced by the secondary reference signals SST(n−2), the disclosure is not limited thereto.

According to the embodiments of the disclosure, since a previous primary reference signal ST is not available, the operations of the first shift registers (e.g., 221 to 223) may refer to the start signal STV. In view of above, in order to satisfy requirements for operating the circuit, when the frame rate is 60 Hz, in addition to the enable periods of the timing signals HC1 to HC6 not being overlapped with each other, it is further set that a falling edge of the start signal STV is synchronized with a falling edge of the timing signal HC1.

Figure 5A:
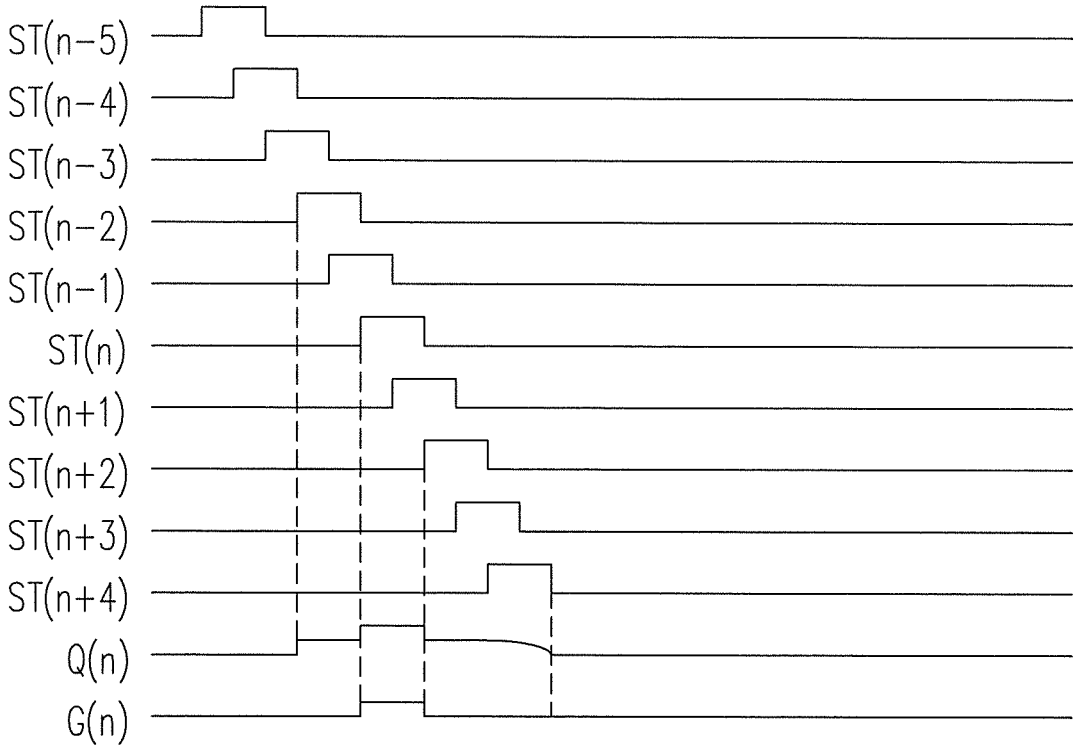
FIG. 5A and FIG. 5B are schematic views illustrating driving waveforms of a display apparatus in a frame rate of 120 Hz according to an embodiment of the disclosure.
Figure 5B:
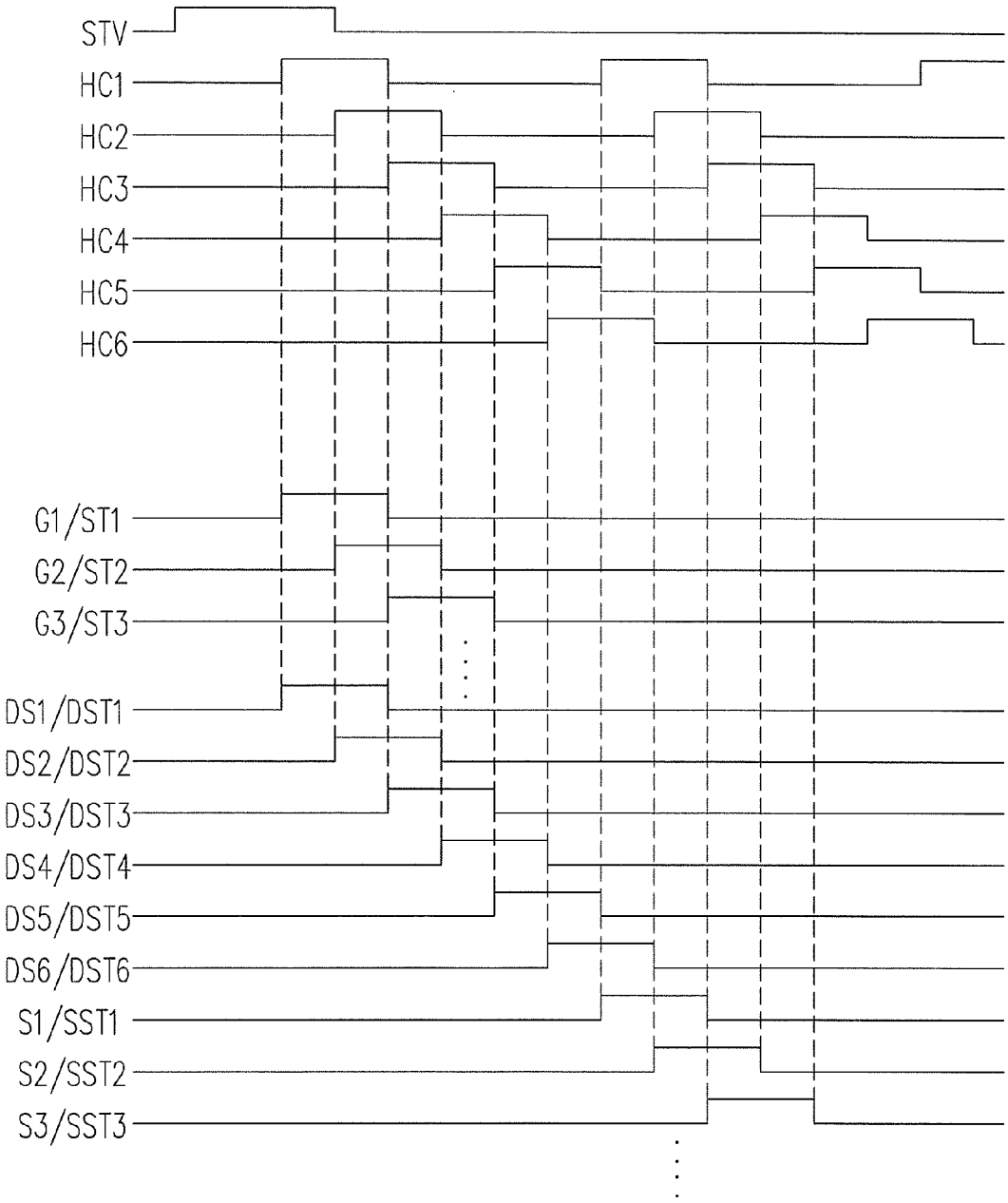

FIG. 5A and FIG. 5B are schematic views illustrating driving waveforms of a display apparatus in a frame rate of 120 Hz according to an embodiment of the disclosure. Referring to FIG. 3A, FIG. 3B, FIG. 5A and FIG. 5B, in the present embodiment, six timing signals (e.g., HC1 to HC6) are taken as an example, a former half portion of the enable period in each of the timing signals (e.g., HC1 to HC6) is overlapped with the enable period of the previous timing signal (e.g., HC1 to HC6), a latter half portion of the enable period in each of timing signals (e.g., HC1 to HC6) is overlapped with the enable period of the next timing signal (e.g., HC1 to HC6). For example, a former half portion of the enable period of the timing signal HC2 is overlapped with the enable period of the timing signal HC1, a latter half portion of enable period of the timing signal HC2 is overlapped with the enable period of the timing signal HC3.

Based on above, when the frame rate is 120 Hz (corresponding to the second frequency), the enable periods of the plurality of primary reference signals (e.g., ST(n−5) to ST(n+4)) outputted form the first shift registers (e.g., 221 to 223) are overlapped with each other, and the enable periods of the primary gate signal (G1 to G3) outputted from the same are overlapped with each other.

Referring to FIG. 3A and FIG. 5A, the transistor T3 is turned on when the primary reference signal ST(n−5) is enabled. The transistor T1 is turned on when the primary reference signal ST(n−4) is enabled, and the enabled primary reference signal ST(n−4) pulls up voltage level of the control terminal of the transistor T6 through the turned-on transistor T3, such that the transistor T6 may be turned on; When the primary reference signal ST(n−2) is enabled, the enabled primary reference signal ST(n−2) may pull up the drive voltage Q(n) through the transistor T6 (which is still turned on). When the primary reference signal ST(n−1) is enabled, voltage level of the control terminal of the transistor T6 is pulled down by the turned-on transistor T4, but the enabled primary reference signal ST(n−1) may pull up the drive voltage Q(n) through the conducted transistor T7, and the transistors T8 and T9 may be conducted when the drive voltage Q(n) is larger than the threshold voltages of the transistors T8 and T9.

Next, when the timing signals HCi received by the first terminals of the transistors T8 and T9 are enabled, the enabled primary gate signal G(n) is outputted from the second terminal of the transistor T8 and the enabled primary reference signal ST(n) is outputted from the second terminal of the transistor T9. In this case, due to voltage drop of the capacitor C1, the drive voltage Q(n) is pulled up higher, such that the first control signal P and the second control signal K cannot be enabled by the first control unit 340 and the second control unit 350. Therefore, voltage levels of the enabled primary gate signal G(n), the enabled primary reference signal ST(n) and the drive voltage Q(n) may not be pulled down by the first auxiliary pull-down unit 360 and the second auxiliary pull-down unit 370.

When the timing signals HCi received by the first terminals of the transistors T8 and T9 are disabled, the first control signal P and the second control signal K are respectively enabled by the first control unit 340 and the second control unit 350 according to the first low-frequency signal LC1 and the second low-frequency signal LC2, respectively. It is assumed that the first low-frequency signal LC1 and the second low-frequency signal LC2 are respectively being an inversion signal to one another, so one of the first control signal P and the second control signal K may be enabled, and voltage levels of the primary gate signal G(n), the primary reference signal ST(n) and the drive voltage Q(n) are pulled down by the first auxiliary pull-down unit 360 or the second auxiliary pull-down unit 370. The pull-down unit 380 is conducted to pull down voltage levels of the drive voltage Q(n) and the primary gate signal G(n) when the primary reference signal ST(n+4) is enabled; in addition, the transistor T5 is turned on to pull down voltage level of the control terminal of the transistor T6.

According to the present embodiment, operations of the second shift register (e.g., 231 to 233) are still similar to operations of the first shift register (e.g., 221 to 223). That is, the enable periods of the secondary reference signals SST(n−5) to SST(n+4) are overlapped with each other, such that the enable periods of the virtual secondary gate signals DS1 to DS6 and the secondary gate signal (e.g., S1 to S3) are overlapped with each other.

As illustrated in FIG. 5B, the enable period of each of the primary gate signals (e.g., G1 to G3) is not overlapped with the enable period of a corresponding secondary gate signal (e.g., S1 to S3), and the enable period of each of the primary gate signals (e.g., G1 to G1) is prior to the enable period of a corresponding secondary gate signal (e.g., S1 to S3). Since the present embodiment is exemplified using a cycle of six timing signals (e.g., HC1 to HC6), the enable period in each of the primary gate signals (e.g., G1 to G3) is substantially prior to that of a corresponding secondary gate signal (e.g., S1 to S3) by six stages. For example, the enable period of the primary gate signal G1 is substantially overlapped with the enable period of the virtual secondary gate signal DS1. Based on above, in some embodiment, the primary reference signal ST(n+4) received by the control terminal of the transistor T17 may be replaced by the secondary reference signals SST(n−2), the disclosure is not limited thereto.

According to the embodiments of the disclosure, since a previous primary reference signal ST is not available, the operations of the first shift registers (e.g., 221 to 223) may refer to the start signal STV. In view of above, in order to satisfy requirements for operating the circuit, when the frame rate is 120 Hz, in addition to the enable periods of the timing signals HC1 to HC6 being overlapped with each other, it is also set that a falling edge of the start signal STV is later than a raising edge of the timing signal HC1.

Figure 6A:
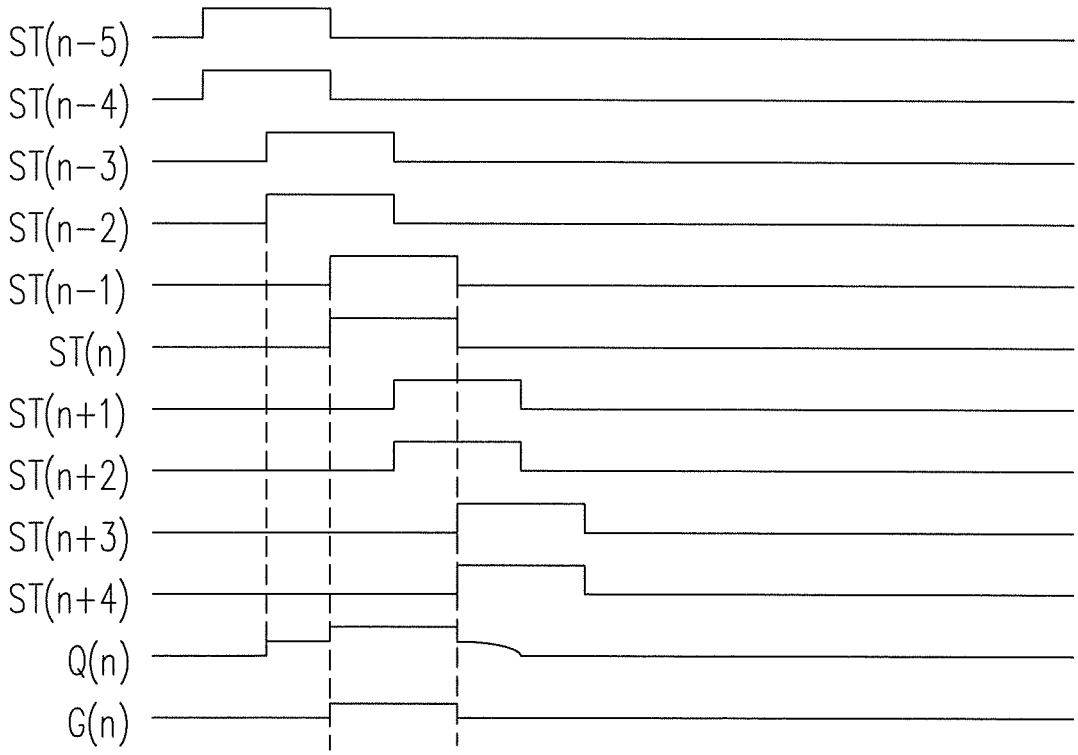
FIG. 6A and FIG. 6B are schematic views illustrating driving waveforms of a display apparatus in a frame rate larger than 120 Hz according to an embodiment of the disclosure.
Figure 6B:
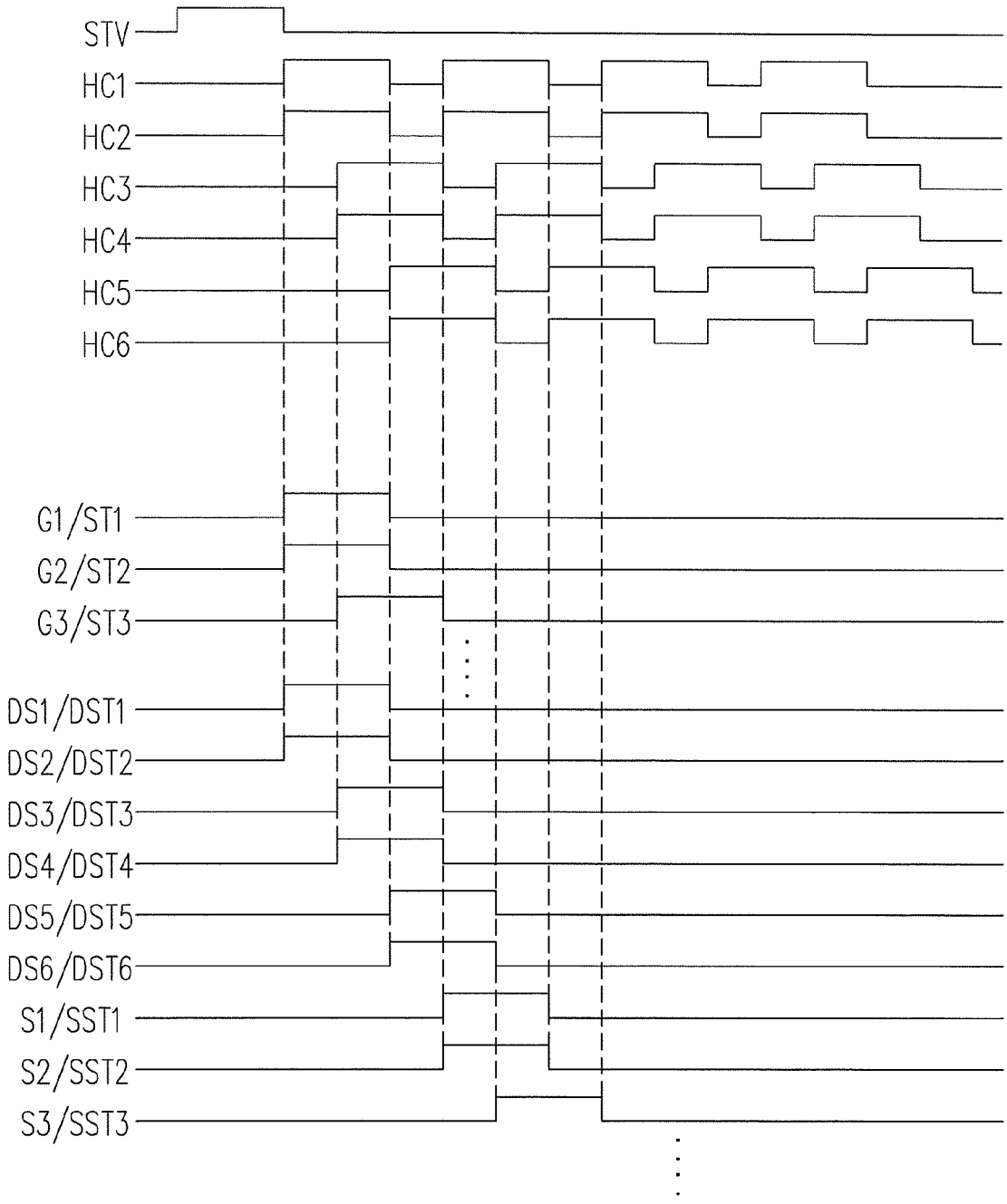

FIG. 6A and FIG. 6B are schematic views illustrating driving waveforms of a display apparatus adapted for 3 dimensional display in a frame rate not smaller than 120 Hz according to an embodiment of the disclosure. Referring to FIG. 3A, FIG. 3B, FIG. 6A and FIG. 6B, in the present embodiment, the enable period in each of the odd number timing signals (e.g., HC1, HC3 and HC5) is entirely overlapped with the enable period of the next even number timing signals (e.g., HC2, HC4 and HC6), a former half portion of the enable period in each of the odd number timing signals (e.g., HC1, HC3 and HC5) is overlapped with the enable period of the previous odd number timing signal (e.g., HC1, HC3 and HC5), and a latter half portion of the enable period in each of the odd number timing signals (e.g., HC1, HC3 and HC5) is overlapped with the enable period of the next odd number timing signal (e.g., HC1, HC3 and HC5). For example, a former half portion of the enable period of the timing signal HC3 is overlapped with the enable period of the timing signal HC1, a latter half portion of enable period of the timing signal HC3 is overlapped with the enable period of the timing signal HC5.

Based on above, when the frame rate is not smaller than 120 Hz (corresponding to a second frequency), two adjacent enable periods of the enable periods of the plurality of primary reference signals (e.g., ST(n−5) to ST(n+4)) outputted form the first shift registers (e.g., 221 to 223) are entirely overlapped with each other, and the enable period of each of the odd number primary reference signal is overlapped respectively with the enable periods of the adjacent prior odd number primary reference signal and the adjacent posterior odd number primary reference signal; and two adjacent enable periods of the enable periods of the plurality of primary gate signals (e.g., G1 to G3) outputted form the first shift registers are entirely overlapped with each other, and the enable periods of each of the odd number primary gate signal is overlapped respectively with the enable periods of the adjacent prior odd number primary gate signal and the adjacent posterior odd number primary gate signal.

Referring to FIG. 3A and FIG. 6A, the transistor T1 and T3 are turned on when the primary reference signals ST(n−5) and ST(n−4) are enabled, and the primary reference signal ST(n−4) pulls up voltage level of the control terminal of the transistor T6 through the turned-on transistor T3, such that the transistor T6 may be turned on; The transistor T2 is turned on when the primary reference signal ST(n−2) is enabled, so as to continuously pull up voltage level of the control terminal of the transistor T6 by the enabled primary reference ST(n−4) through the turned-on transistors T2 and T3, the drive voltage Q(n) is pulled up by the enabled primary reference signal ST(n−2) through the conducted transistor T6, and the transistors T8 and T9 are turned on when the drive voltage Q(n) is larger than the threshold voltages of the transistors T8 and T9.

When the primary reference signal ST(n−1) is enabled, voltage level of the control terminal of the transistor T6 is pulled down through the conducted transistor T4, but the drive voltage Q(n) is continuously pulled up by the enabled primary reference signal ST(n−1) through the turned-on transistor T7. Further, it is assumed that the timing signal HCi received by the first terminals of the transistors T8 and T9 are enabled, so that an enabled primary gate signal G(n) may be outputted from the second terminal of the transistor T8, an enabled primary reference signal ST(n) may be outputted from the second terminal of the transistor T9. In this case, due to voltage drop of the capacitor C1, the drive voltage Q(n) is pulled up higher, such that the first control signal P and the second control signal K cannot be enabled by the first control unit 340 and the second control unit 350. Therefore, voltage levels of the enabled primary gate signal G(n), the enabled primary reference signal ST(n) and the drive voltage Q(n) may not be pulled down by the first auxiliary pull-down unit 360 and the second auxiliary pull-down unit 370.

When the timing signals HCi received from the first terminals of the transistors T8 and T9 are disabled, the first control signal P and the second control signal K are respectively enabled by the first control unit 340 and the second control unit 350 according to the first low-frequency signal LC1 and the second low-frequency signal LC2, respectively. It is assumed that the first low-frequency signal LC1 and the second low-frequency signal LC2 are respectively being an inversion signal to one another, so one of the first control signal P and the second control signal K may be enabled, and voltage levels of the primary gate signal G(n), the primary reference signal ST(n) and the drive voltage Q(n) are pulled down by the first auxiliary pull-down unit 360 or the second auxiliary pull-down unit 370. The pull-down unit 380 is conducted to pull down voltage levels of the drive voltage Q(n) and the primary gate signal G(n) when the primary reference signal ST(n+4) is enabled; in addition, the transistor T5 is turned on to pull down voltage level of the control terminal of the transistor T6.

In the present embodiment, operations of the second shift registers (e.g., 231 to 233) are similar to that of the first shift register (e.g., 221 to 223). That is, two adjacent enable periods of the enable periods of the plurality of secondary reference signals (e.g., SST(n−5) to SST(n+4)) are entirely overlapped with each other and the enable period of each of odd number secondary reference signals is overlapped with the enable periods of the adjacent prior odd number secondary reference signal and the adjacent posterior odd number secondary reference signal, and two adjacent enable periods of the enable periods of the virtual secondary gate signals DS1 to DS6 and the secondary gate signal (e.g., S1 to S3) are entirely overlapped with each other, and the enable period in each of the odd number secondary virtual gate signals or in each of the odd number secondary virtual gate signals is overlapped with the enable periods of the adjacent prior odd number secondary virtual gate signal or the adjacent prior odd number secondary gate signals and the adjacent posterior odd number secondary virtual gate signal or the adjacent posterior odd number secondary gate signal.

As illustrated in FIG. 6B, the enable period of each of the primary gate signals (e.g., G1 to G3) is not overlapped with the enable period of a corresponding secondary gate signals (e.g., S1 to S3), and the enable period of each of the primary gate signals (e.g., G1 to G1) is prior to the enable period of a corresponding secondary gate signals (e.g., S1 to S3). The enable period in each of the primary gate signals (e.g., G1 to G3) is substantially prior to the corresponding secondary gate signal (e.g., S1 to S3) by six stages. For example, the enable period of the primary gate signal G1 is substantially overlapped with the enable period of the virtual secondary gate signal DS1. Based on above, in some embodiment, the primary reference signal ST(n+4) received by the control terminal of the transistor T17 may be replaced by the secondary reference signals SST(n−2), the disclosure is not limited thereto.

According to the embodiments of the disclosure, since a previous primary reference signal ST is not available, the operations of the first shift registers (e.g., 221 to 223) may refer to the start signal STV. In view of above, in order to satisfy requirements for operating the circuit, when the frame rate is not smaller than 120 Hz, in addition to two adjacent enable periods of the enable periods of the timing signals HC1 to HC6 being overlapped with each other and the enable period of each of the odd number timing signals (e.g., HC1, HC3 and HC5) being overlapped with the enable periods of the adjacent prior odd number timing signals and the adjacent posterior odd number timing signals (e.g., HC1, HC3 and HC5), it is also set that the falling edge of the start signal STV is synchronized with the raising edge of the timing signal HC1.

According to FIG. 1, FIG. 2, FIG. 3A, FIG. 3B, FIG. 4A, FIG. 4B, FIG. 5A, FIG. 5B, FIG. 6A and FIG. 6B, the timing controller 110 determines a driving method for the pixel array 123 according to the a frame rate of the display apparatus 100, and adjusts the enable periods and overlapping relations of the start signal STV and the timing signals HC1 to HC6. As a result, the enable periods and the overlapping relations of the primary gate signals (e.g., G1 to G3) may be adjusted and the enable periods and the overlapping relations of the virtual secondary gate signal DS1 to DS6 and the secondary gate signal (e.g., S1 to S3) may be adjusted, thereby increasing a commonality of the gate drive circuit 121.

Moreover, in the above embodiments, regardless of which driving method being used, the drive voltage Q(n) may have sufficient time for pulling up in all cases. That is, the capacitor C1 may have sufficient time which allows the drive voltage Q(n) to have a higher voltage level, in other words, the capacitor C1 may have a higher voltage drop. As a result, the channel size of the transistor T8 used for outputting the primary gate signal (e.g., G to G3) or the secondary gate signal (such as S1 to S3) may be implemented using a smaller channel size of transistor, so as to reduce the border width of the display panel 120.

Figure 7:
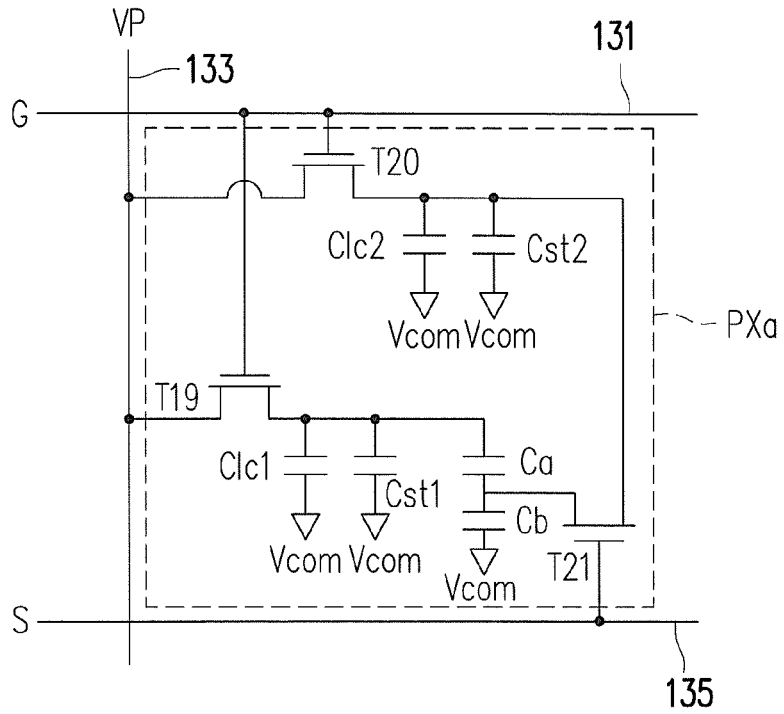
FIG. 7 is a schematic view of circuits in a pixel according to an embodiment of the disclosure.

FIG. 7 is a schematic view of circuits in a pixel according to an embodiment of the disclosure. Referring to FIG. 1 and FIG. 7, the pixel in the present embodiment is designed to include two gate signals to respectively execute charing and sharing processes, for solving washout problem to accomplish a better display effect. Each pixel PXa includes transistors T19 to T21, a first storage capacitor Cst1, a first crystal liquid capacitor Clc1, a second storage capacitor Cst2, a second crystal liquid capacitor Clc2, capacitors Ca and Cb. The transistor T19 has a first terminal electrically connected to a corresponding data line 133, a control terminal electrically connected to a corresponding first gate line 131 and a second terminal. The first storage capacitor Cst1 is electrically connected between the second terminal of the transistor T19 and a common voltage terminal Vcom. The first crystal liquid capacitor Clc1 is electrically connected between the second terminal of the transistor T19 and the common voltage terminal Vcom. The capacitors Ca and Cb are electrically connected in series between the second terminal of the transistor T19 and the common voltage terminal Vcom.

The transistor T20 has a first terminal electrically connected to a corresponding data line 133, a control terminal electrically connected to a corresponding first gate line 131 and a second terminal. The second storage capacitor Cst2 is electrically connected between the second terminal of the transistor T20 and the common voltage terminal Vcom. The second crystal liquid capacitor Clc2 is electrically connected between the second terminal of the transistor T20 and the common voltage terminal Vcom. The transistor T21 has a first terminal electrically connected to the second terminal of the transistor T20, a control terminal electrically connected to a corresponding second gate line 135 and a second terminal electrically connected between the capacitors Ca and Cb.

Figure 8:
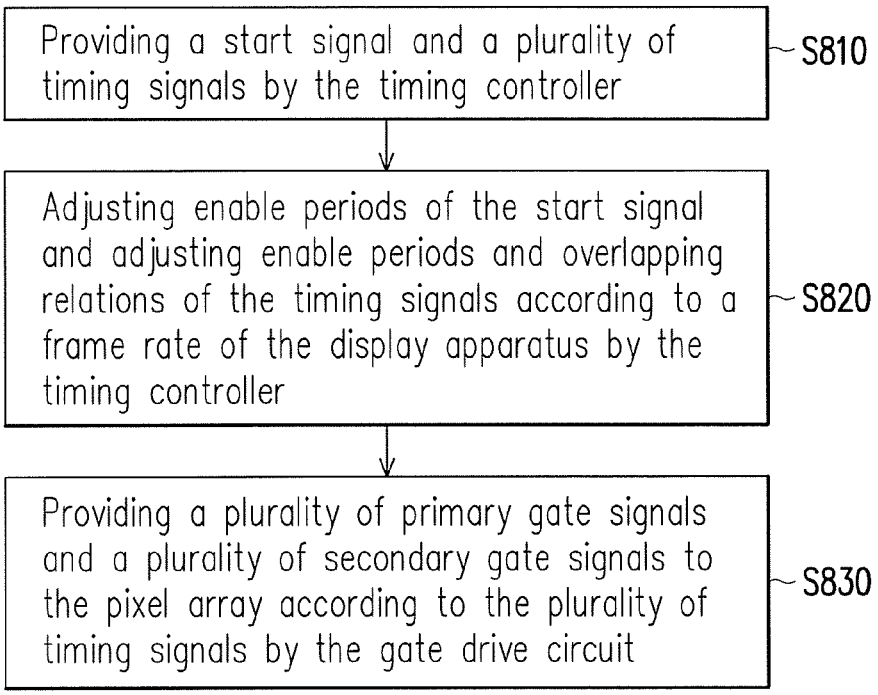
FIG. 8 is a flow chart illustrating a method for generating gate signal of a display apparatus according to an embodiment of the disclosure.

FIG. 8 is a flow chart illustrating a method for generating gate signal of a display apparatus according to an embodiment of the disclosure. Referring to FIG. 8, according to the present embodiment, the display apparatus includes a pixel array, a timing controller and a gate drive circuit. The method for generating gate signal of the display apparatus includes the following steps. Providing a start signal and a plurality of timing signals by the timing controller (Step S810). Adjusting enable period of the start signal and adjusting enable periods and overlapping relations of the timing signals according to a frame rate of the display apparatus by the timing controller (Step S820). Providing a plurality of primary gate signals and a plurality of secondary gate signals to the pixel array according to the plurality of timing signals by the gate drive circuit (Step S830). In which, the sequence of the above steps is merely an example, the embodiments of the disclosure are not limited thereto. Further, detailed information regarding the above steps may refer to the embodiments as illustrated in FIG. 1, FIG. 2, FIG. 3A, FIG. 3B, FIG. 4A, FIG. 4B, FIG. 5A, FIG. 5B, FIG. 6A and FIG. 6B, so it is omitted hereinafter.

In view of above, the embodiments of the disclosure provide a display apparatus and a method for generating gate signal using the same, in which the timing controller adjusts enable periods and overlapping relations of a start signal and the timing signals according to a frame rate of the display apparatus. As a result, enable periods and overlapping relations of the primary gate signals may be adjusted, and enable periods and overlapping relations of the virtual secondary gate signal and the secondary gate signal may also be adjusted, thereby increasing a commonality of the gate drive circuit. Further, the drive voltage may have a sufficient time for pulling up, so as to allow the drive voltage to have a higher voltage level. As a result, the channel size of the transistor used for outputting the primary gate signal or the secondary gate signal may be reduced, so as to reduce the border width of the display panel.

Although the disclosure has been described with reference to the above embodiments, it is apparent to one of the ordinary skill in the art that modifications to the described embodiments may be made without departing from the spirit of the disclosure. Accordingly, the scope of the disclosure will be defined by the attached claims not by the above detailed descriptions.

What is claimed is:

1. A display apparatus, comprising:

a timing controller, configured for providing a plurality of timing signals and adjusting overlapping relations of the timing signals on a time sequence according to a frame rate of the display apparatus;

a display panel, comprising:

a pixel array having a plurality of pixel units; and a gate drive circuit, electrically connected to the timing controller and the pixel array, comprising a plurality of shift register circuits, wherein an Nth stage shift register circuit comprises:

a first shift register, configured for generating an Nth stage primary gate signal; and a second shift register, configured for generating an Nth stage secondary gate signal, wherein N is a natural number;

wherein the first shift register and the second shift register respectively comprises:

a pull-up unit for raising a drive voltage according to an (N−1)th stage reference signal, an (N−2)th stage reference signal, an (N−4)th stage reference signal, an (N−5)th stage reference signal and an (N+4)th stage reference signal;

a drive unit for receiving a first timing signal and outputting the Nth stage primary gate signal or the Nth stage secondary gate signal according to the drive voltage and the first timing signal;

an auxiliary drive unit for receiving the first timing signal and outputting an Nth stage reference signal according to the drive voltage and the first timing signal;

a first control unit for receiving a first low-frequency signal and generating a first control signal according to the first low-frequency signal;

a second control unit for receiving a second low-frequency signal and generating a second control signal according to the second low-frequency signal;

a first auxiliary pull-down unit, electrically connected to a first low voltage, a second low voltage and the first control signal, for pulling down the Nth stage reference signal and the Nth stage primary gate signal or the Nth stage secondary gate signal according to the first control signal;

a second auxiliary pull-down unit, electrically connected to the first low voltage, the second low voltage and the second control signal, for pulling down the Nth stage reference signal and the Nth stage primary gate signal or the Nth stage secondary gate signal according to the second control signal; and a pull-down unit, receiving the second low voltage and the (N+4)th stage reference signal, and pulling down the drive voltage, the Nth stage primary gate signal or the Nth stage secondary gate signal according to the (N+4)th stage reference signal.

2. The display apparatus of claim 1, wherein the pull-up unit comprises:

a first transistor having a first terminal for receiving the (N−2)th stage reference signal, a control terminal for receiving the (N−4)th stage reference signal, and a second terminal;

a second transistor having a first terminal for receiving the (N−4)th stage reference signal, a control terminal electrically connected to the second terminal of the first transistor, and a second terminal;

a third transistor having a first terminal for receiving the (N−4)th stage reference signal, a control terminal for receiving the (N−5)th stage reference signal, and a second terminal electrically connected to the second terminal of the second transistor;

a fourth transistor having a first terminal for receiving the (N−4)th stage reference signal, a control terminal for receiving the (N−1)th stage reference signal, and a second terminal electrically connected to the second terminal of the second transistor;

a fifth transistor having a first terminal for receiving the (N−4)th stage reference signal, a control terminal for receiving the (N+4)th stage reference signal, and a second terminal electrically connected to the second terminal of the second transistor;

a sixth transistor having a first terminal for receiving the (N−2)th stage reference signal, a control terminal electrically connected to the second terminal of the second transistor, and a second terminal for outputting the drive voltage; and a seventh transistor having a first terminal for receiving the (N−1)th stage reference signal, a control terminal electrically connected to the first terminal of the seventh transistor, and a second terminal electrically connected to the second terminal of the sixth transistor.

3. The display apparatus of claim 1, wherein the drive unit comprises:

an eighth transistor having a first terminal for receiving the first timing signal, a control terminal for receiving the drive voltage, and a second terminal for outputting the Nth stage primary gate signal or the Nth stage secondary gate signal.

4. The display apparatus of claim 3, wherein the drive unit further comprises:

a capacitor, electrically connected between the control terminal of the eighth transistor and the second ten Anal of the eighth transistor.

5. The display apparatus of claim 1, wherein the auxiliary drive unit comprises:

an ninth transistor having a first terminal for receiving the first timing signal, a control terminal for receiving the drive voltage, and a second terminal for outputting the Nth stage reference signal.

6. The display apparatus of claim 1, wherein the first control unit and the second control unit respectively comprises:

a tenth transistor having a first terminal for receiving the first low-frequency signal or the second low-frequency signal, a control terminal electrically connected to the first terminal of the tenth transistor, and a second terminal;

an eleventh transistor having a first terminal electrically connected to the second terminal of the tenth transistor, a control terminal for receiving the drive voltage, and a second terminal electrically connected to the first low voltage;

a twelfth transistor having a first terminal electrically connected to the first terminal of the tenth transistor, a control terminal electrically connected to the second terminal of the tenth transistor, and a second terminal for outputting the first control signal or the second control signal; and a thirteenth transistor having a first terminal electrically connected to the second terminal of the twelfth transistor, a control terminal electrically connected to the control terminal of the eleventh transistor, and a second terminal electrically connected to the first low voltage.

7. The display apparatus of claim 1, wherein the first auxiliary pull-down unit and the second auxiliary pull-down unit respectively comprises:

a fourteenth transistor having a first terminal electrically connected to the drive voltage, a control terminal for receiving the first control signal or the second control signal, and a second terminal for receiving the Nth stage reference signal;

a fifteenth transistor having a first terminal electrically connected to the Nth stage primary gate signal or the Nth stage secondary gate signal, a control terminal electrically connected to the control terminal of the fourteenth transistor, and a second terminal electrically connected to the second low voltage; and a sixteenth transistor having a first terminal for receiving the Nth stage reference signal, a control terminal electrically connected to the control terminal of the fourteenth transistor, and a second terminal electrically connected to the first low voltage.

8. The display apparatus of claim 1, wherein the pull-down unit comprises:

a seventeenth transistor having a first terminal electrically connected to the drive voltage, a control terminal for receiving the (N+4)th stage reference signal, and a second terminal electrically connected to the second low voltage; and an eighteenth transistor having a first terminal electrically connected to the Nth stage primary gate signal or the Nth stage secondary gate signal, a control terminal electrically connected to the control terminal of the seventeenth transistor, and a second terminal electrically connected to the second low voltage.

9. The display apparatus of claim 1, wherein the first low voltage is not larger than the second low voltage.

10. The display apparatus of claim 1, wherein the gate drive circuit further comprises:

a plurality of virtual second shift registers, respectively receiving one of the timing signals and generate a plurality of virtual secondary gate signals.

11. The display apparatus of claim 1, wherein the display panel further comprises:

a data line, configured for receiving a corresponding pixel voltage;

a first gate line, configured for receiving the corresponding primary gate signal; and a second gate line, configured for receiving the corresponding secondary gate signal.

12. The display apparatus of claim 11, wherein each of the pixel units comprises:

a nineteenth transistor having a first terminal electrically connected to the data line, a control terminal electrically connected to the first gate line, and a second terminal;

a first storage capacitor, electrically connected between the second terminal of the nineteenth transistor and a common voltage terminal;

a first crystal liquid capacitor, electrically connected between the second terminal of the nineteenth transistor and the common voltage terminal;

a first capacitor and a second capacitor, electrically connected in series between the second terminal of the nineteenth transistor and the common voltage terminal;

a twentieth transistor having a first terminal electrically connected to the data line, a control terminal electrically connected to the first gate line, and a second terminal;

a second storage capacitor, electrically connected between the second terminal of the twentieth transistor and the common voltage terminal;

a second crystal liquid capacitor, electrically connected between the second terminal of the twentieth transistor and the common voltage terminal; and a twenty-first transistor having a first terminal electrically connected to the second terminal of the twentieth transistor, a control terminal electrically connected to the second gate line, and a second terminal electrically connected between the first capacitor and the second capacitor.

13. A method for generating gate signals in a display apparatus, comprising:

providing a start signal and a plurality of timing signals;

adjusting an enable period of the start signal and enable periods and overlapping relations of the timing signals according to a frame rate of the display apparatus; and providing a plurality of primary gate signals and a plurality of secondary gate signals to a pixel array according to the plurality of timing signals, wherein when the frame rate is not smaller than a second frequency, a falling edge of the start signal is synchronized with a raising edge of a first timing signal among the plurality of timing signals, an enable period in each of odd number timing signals among the plurality of timing signals is entirely overlapped with an enable period in a next even number timing signal among the plurality of timing signals, a former half portion of the enable period in each of the plurality of odd number timing signals is overlapped with an enable period of a previous odd number timing signal, and a latter half portion of the enable period in each of the plurality of odd number timing signals is overlapped with an enable period of a next odd number timing signal.

14. The method of claim 13, wherein when the frame rate is a first frequency, the falling edge of the start signal is synchronized with a falling edge of the first timing signal among the plurality of timing signal, and the enable periods of the plurality of timing signals are not overlapped with each other.

15. The method of claim 13, wherein when the frame is the second frequency, the falling edge of the start signal is later than the raising edge of the first timing signal among the plurality of timing signals, a former half portion of the enable period in each of the plurality of timing signals is overlapped with an enable period of a previous timing signal, and a latter half portion of the enable period in each of the plurality of timing signals is overlapped with an enable period of a next timing signal.

16. The method of claim 13, further comprising each of the plurality of primary gate signals not being overlapped with the corresponding secondary gate signal, and each of the plurality of primary gate signal being outputted prior to the corresponding secondary gate signal.

* * * * *